United States Patent [19]

Ziemelis

[11] Patent Number: 4,774,743

[45] Date of Patent: Oct. 4, 1988

[54] JEWELRY CLASP

[75] Inventor: Hebert Ziemelis, Wallingford, Conn.

[73] Assignee: The Napier Co., Meriden, Conn.

[21] Appl. No.: 73,441

[22] Filed: Jul. 14, 1987

[51] Int. Cl.[4] ..... F16G 15/00

[52] U.S. Cl. ..... 24/598; 24/116 A; 24/616

[58] Field of Search ..... 24/598, 599, 616, 618, 24/116 A, 336, 541, 585, 609; 63/3, 19, 14 C

[56] References Cited

U.S. PATENT DOCUMENTS

| | | | |
|---|---|---|---|
| 1,754,959 | 4/1930 | Matushenko | 24/598 |
| 1,991,287 | 2/1935 | Martin | 24/598 |
| 2,020,163 | 10/1979 | Sauer et al. . | |
| 2,178,572 | 11/1939 | Forstner | 24/618 |
| 2,181,222 | 11/1939 | Winkler | 24/616 |
| 2,453,993 | 3/1945 | Kreisler . | |
| 2,462,425 | 2/1949 | Pratt et al. | 63/3 |
| 2,554,303 | 5/1951 | Longhenrich | 24/116 A |
| 2,595,462 | 5/1952 | Johnson | 24/116 A |
| 3,168,768 | 2/1965 | Bohlinger et al. | 24/116 A |
| 3,181,217 | 5/1965 | Bohlinger et al. | 24/116 A |
| 3,844,000 | 10/1974 | Hedu | 24/618 |
| 4,314,389 | 6/1935 | Salvo . | |

FOREIGN PATENT DOCUMENTS

| | | | |
|---|---|---|---|
| 0139387 | 12/1948 | Australia | 24/618 |
| 0051110 | 12/1935 | Denmark | 24/599 |
| 0017823 | 3/1906 | United Kingdom | 24/616 |
| 0217756 | 6/1924 | United Kingdom | 24/616 |
| 1132027 | 10/1968 | United Kingdom | 24/598 |

*Primary Examiner*—Victor N. Sakran

*Attorney, Agent, or Firm*—Hayes & Reinsmith

[57] ABSTRACT

A jewelry clasp having a base and a cover mounted on the base for swinging movement and featuring a pair of elongated resilient S-shaped friction tongs on the base for snap-locking engagement within elongated grooves of a pair of complementary resilient friction flanges on the cover for releasably securing the base and its cover in locked position.

10 Claims, 4 Drawing Sheets

JEWELRY CLASP

FIELD OF THE INVENTION

This invention generally relates to jewelry clasps and more particularly concerns jewelry clasps of a type including a base and swinging cover supported on the base for movement between an open position and a locked position.

BACKGROUND OF THE INVENTION

Jewelry clasps are used for interconnecting free ends of necklaces, chains, bracelets and similar type jewelry. To effect longer lasting usage, a variety of different approaches have been used as evidenced by the prior art. Normally, the locking of a jewelry clasp is delicate in nature and subject to seemingly incompatible objectives of providing security in a relatively small aesthetically pleasing construction.

OBJECTS OF THE INVENTION

A principle object of this invention is to provide a new and improved jewelry clasp which is structurally and functionally superior to known clasps and jewelry catches. Related to this object is the aim of providing such a clasp which not only securely locks free ends of an attachable jewelry device but effects such a locking function in a clasp featuring simplicity of design and integrity of function.

Another object of this invention is to provide a clasp of the above described type which is economical to manufacture, comprised of a minimum number of parts and is quick and easy to use repeatedly and reliably over an extended period of time.

Other objects will be in part obvious and in part pointed out in more detail hereinafter.

A better understanding of the objects, advantages, features, properties and relations of the invention will be obtained from the following detailed description and accompanying drawings which sets forth an illustrative embodiment and is indicative of the various ways in which the principle of the invention is employed.

DETAILED DESCRIPTION OF A PREFERRED EMBODIMENT

Figure 8:
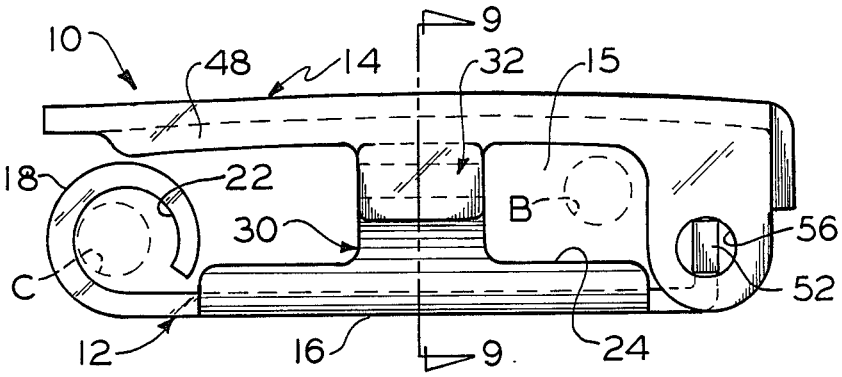
FIG. 8 is a side view showing the base and cover of the clasp of this invention in assembled relation.
Figure 10:
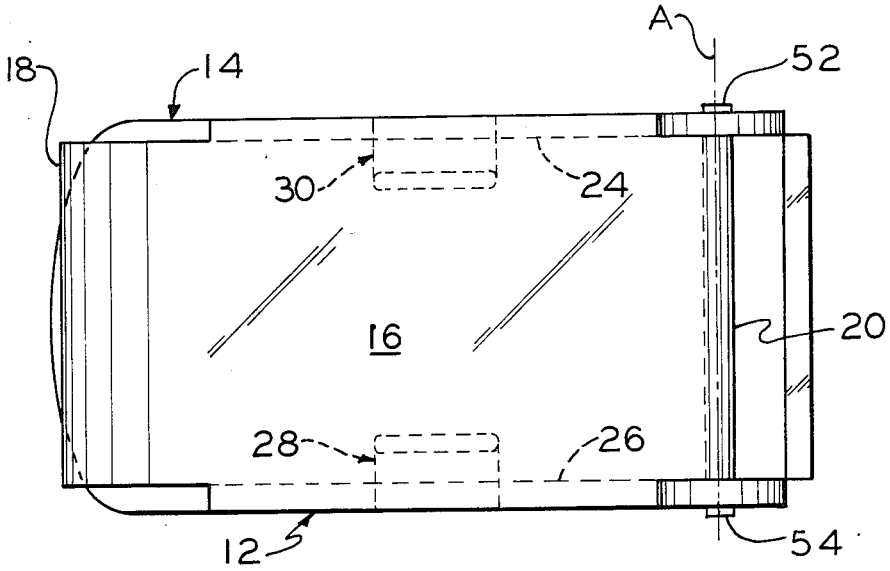
FIG. 10 is a bottom plan view of the assembled clasp of FIG. 8.

Referring in detail to the drawings, a jewelry clasp of this invention is generally indicated by numeral 10 and comprises an elongated base 12 and cover 14 wherein cover 14 is supported on base 12 for swinging movement about a pivot axis A (FIG. 10) between an open position (not shown) and a locked position (FIG. 8). In locked position, the clasp 10 will be understood to secure attachable free end links B and C of a jewelry device in first and second openings 15 and 22 (FIG. 8).

More specifically, base 12 includes a base plate 16 of generally rectangular configuration having a coiled end or eye 18 at one end and a laterally extending cross-bar 20 at an opposite end of plate 16. Eye 18 of the base plate 16 forms the above mentioned laterally extending opening 22 which engages a free end link C of a chain, necklace, bracelet or the like, not shown. The base plate 16 further includes a pair of upright side walls 24, 26 on opposite lateral sides of the plate 16 and upstanding resilient friction tongs 28, 30 which project upwardly midway along the length of each base side wall 24, 26.

Figure 1:
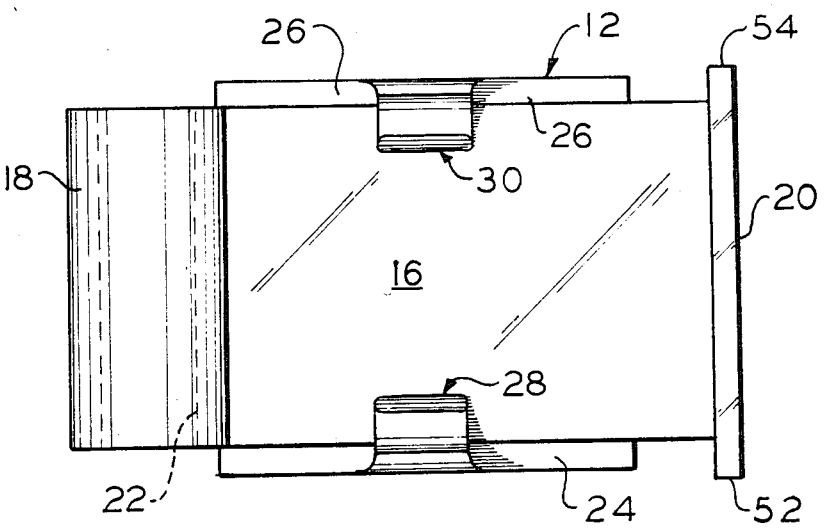
FIG. 1 is a plan view of a base of a clasp of this invention.
Figure 2:
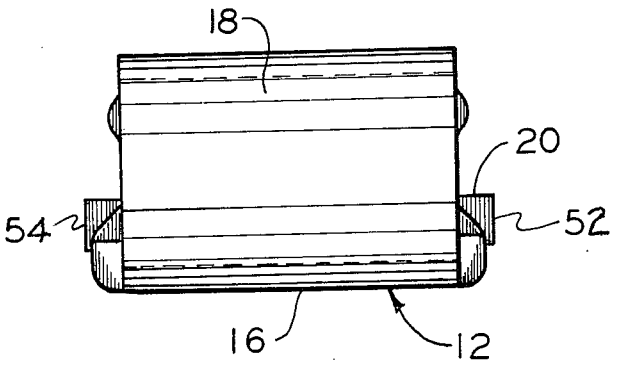
FIG. 2 is an end view of the base of FIG. 1.
Figure 3:
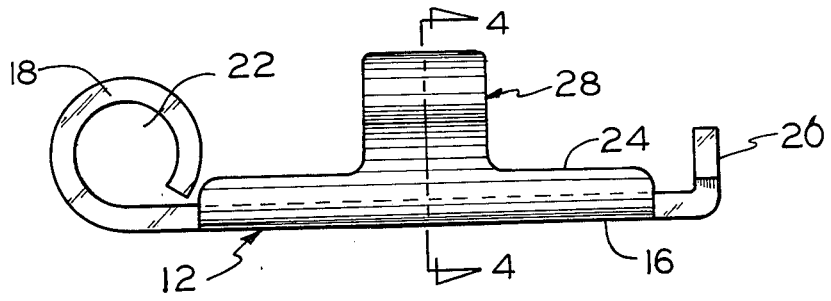
FIG. 3 is a side view of the base of FIG. 1.
Figure 4:
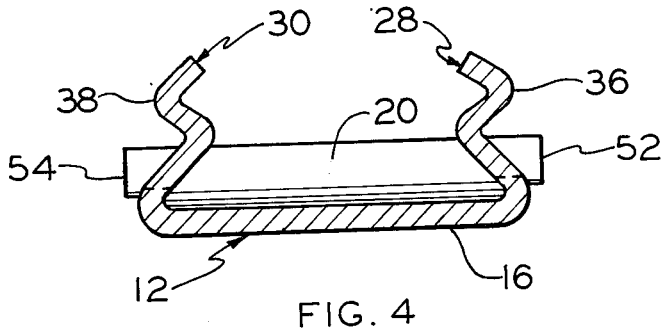
FIG. 4 is a cross-sectional view, taken generally along line 4—4 of FIG. 3.
Figure 5:
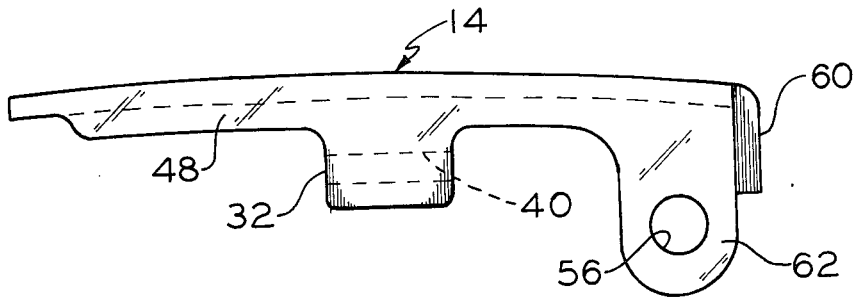
FIG. 5 is a side view of a cover of a clasp of this invention.
Figure 6:
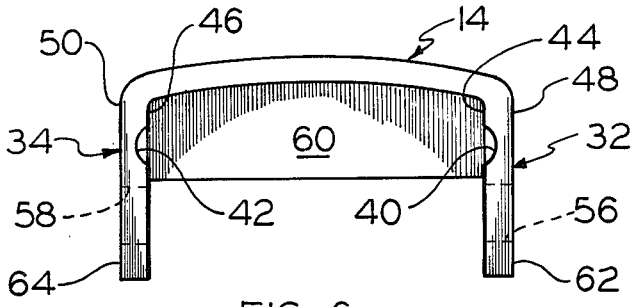
FIG. 6 is an end view of the cover of FIG. 5.
Figure 7:
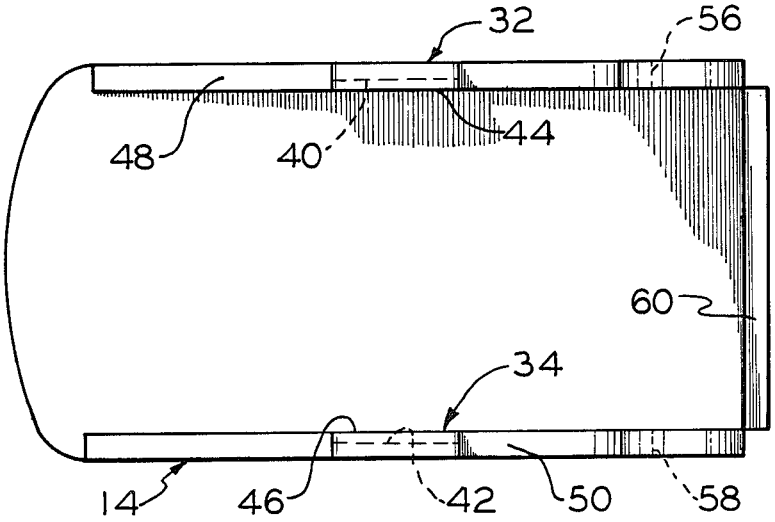
FIG. 7 is a bottom plan view of the cover of FIG. 5.
Figure 9:
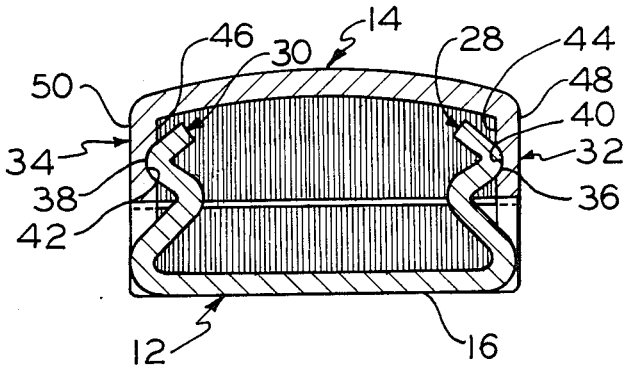
FIG. 9 is a cross-sectional view, taken generally along line 9—9 of FIG. 8, with certain parts deleted for purposes of clarity.

In accordance with the teachings of this invention, each of the upstanding friction tongs 28, 30 is particularly suited to provide significantly increased surface-to-surface contact engagement with corresponding elongated friction tongs or flanges 32, 34 formed on the cover 14. More specifically, the friction tongs 28, 30 are each of serpentine or generally S-shaped cross-section in mirror-image relation to one another (FIGS. 4 and 9) and include an off-set shoulder 36, 38 for mating registration with a longitudinally extending, complementary recessed locking groove 40, 42 (FIG. 6) on an elongated inner face 44, 46 of each of the depending elongated resilient friction flanges 32, 34 extending downwardly from opposed side walls 48, 50 of the swinging cover 14. The longitudinally extending recessed locking grooves 40, 42 are best seen in FIGS. 6 and 7. The inner face 44, 46 of each depending friction flange 32, 34 is particularly suited to fully engage the off-set shoulder 36, 38 (FIG. 9) of each friction tong 28, 30 when the base 12 and cover 14 are assembled and snapped into locked position (FIG. 8).

By virtue of the above described construction, the base 12 and cover 14 are each formed as relatively simple parts of one-piece construction, and significantly increased surface-to-surface area contact is obtained between the complementary base and cover tongs. This structure is in sharp contrast to that of known prior art devices and significantly increases the effectiveness of the locking mechanism, its usability over extended periods of time and its reliability and wearability of the product with which the clasp 10 is associated.

To effect a clasp 10 of structural integrity and simplicity of design thereby to minimize manufacturing cost and further enhance wearability and usage, the base 12 features a pair of fingers 52, 54 projecting in opposite lateral directions from ends of cross bar 20 and which jointly define pivot axis A for swinging cover 14 upon mounting fingers 52, 54 in mating openings 56, 58 respectively formed in a pair of ears 62, 64 depending from cover 14 adjacent its end wall 60.

As will be apparent to persons skilled in the art, various modifications, adaptations and variations of the foregoing specific disclosure can be made without departing from the teachings of this invention.

I claim:

1. A jewelry clasp comprising a base, a cover supported on the base for swinging movement between an open position and a locked position, the base and the cover members each having a pair of elongated friction locking tongs interengageable with the tongs of the other member, the cover tongs each being integrally formed in depending relation to the cover and including an elongated locking groove, the base tongs each being of generally S-shaped cross-section, the base tongs each being integrally formed on the base in upstanding relation thereto and defining an elongated off-set shoulder registrable with the locking groove of the corresponding cover tong in direct surface-to-surface area contact therewith for releasably securing the base and cover in locked position.

2. The clasp of claim 1 further including projections formed on one of said base and cover members, the other of said base and cover members including a pair of projection receiving openings and supporting the projections for rotation, whereby the cover is supported on the base for swinging movement about a pivot axis defined by the projections.

3. The clasp of claim 2 wherein the projections comprise a pair of fingers integrally formed on the base to extend in opposite directions from an end wall of the base, and wherein the cover includes a pair of depending ears each having an opening formed therein for receiving the fingers.

4. The clasp of claim 1 wherein the base includes an elongated rectangular plate having a coiled end defining a laterally extending eye and an opposite end defining a cross-bar in upstanding relation to the plate and extending laterally of the plate, opposite ends of the cross bar having projecting fingers extending in opposite directions, and wherein the cover includes depending apertured ears defining openings for receiving the projecting fingers of the base plate and supporting the cover for swinging movement between said opened and locked positions.

5. The clasp of claim 4 wherein the cover includes a swinging free end, the swinging free end in said locked position being in overlapping relation to the coiled end of the base.

6. The clasp of claim 4 wherein the base and cover members in locked position jointly define a first attachable link opening for the clasp, and wherein the coiled end of the base defines a second attachable link opening for the clasp.

7. The clasp of claim 1 wherein the complementary tongs of the base and cover are each formed of a suitable resilient material to effect snap-locking engagement for releasably securing the base and cover in said locked position.

8. The clasp of claim 1 wherein the cover tongs each have a substantially smooth uninterrupted outer face in lapping relation to the corresponding friction locking tongs of the base in said locked position.

9. A jewelry clasp comprising a base, a cover supported on the base for swinging movement between an open position and a locked position, the base and cover members having interengageable friction locking tongs and flanges, the base and cover each being of a generally elongated configuration, the base having a first tong of generally S-shaped cross-section defining an elongated off-set shoulder formed on the base in upstanding relation to one side thereof and a second tong of generally S-shaped cross-section formed on the base in upstanding relation to a side thereof opposite said one side, a first flange including an elongated locking groove being formed on one side of the cover, and a second flange including an elongated locking groove being formed on an opposite side of the cover to provide a pair of depending flanges on the cover each having a longitudinally extending locking groove on an inner face thereof, the elongated off-set shoulders of the tongs each being registrable with the locking groove of the corresponding friction locking flange of the base in direct surface-to-surface contact therewith for releasably securing the base and cover in locked position.

10. The clasp of claim 9 wherein the flanges of the cover each have a substantially smooth uninterrupted outer face in lapping relation to the corresponding friction locking tongs of the base in said locked position.

* * * * *